US006140772A

United States Patent [19]

Bishop

[11] Patent Number: 6,140,772

[45] Date of Patent: Oct. 31, 2000

[54] METHOD AND APPARATUS FOR CONTROL OF FLUORESCENT LAMPS

[75] Inventor: Gary D. Bishop, Marion, Iowa

[73] Assignee: Rockwell Collins, Inc., Cedar Rapids, Iowa

[21] Appl. No.: 09/360,514

[22] Filed: Jul. 26, 1999

[51] Int. Cl.[7] ..... H05B 39/04

[52] U.S. Cl. ..... 315/106; 315/309; 307/31; 307/116

[58] Field of Search ..... 315/106, 291, 315/293, 307, 309, DIG. 5, DIG. 7; 307/31, 35, 39, 116, 117

[56] References Cited

U.S. PATENT DOCUMENTS

| | | | |
|---|---|---|---|
| 3,921,032 | 11/1975 | Hallay | 315/309 |
| 4,283,657 | 8/1981 | Gordon et al. | 315/86 |
| 5,132,595 | 7/1992 | Kulka et al. | 315/106 |
| 5,424,611 | 6/1995 | Moriarty, Jr. | 315/94 |
| 5,623,184 | 4/1997 | Rector | 315/106 |
| 5,642,016 | 6/1997 | Shalvi | 315/158 |
| 5,747,777 | 5/1998 | Matsuoka | 219/497 |
| 5,798,614 | 8/1998 | Bishop | 315/106 |
| 5,925,990 | 7/1999 | Crouse et al. | 315/DIG. 7 |
| 5,939,836 | 8/1999 | Mita et al. | 315/307 |

*Primary Examiner*—Don Wong
*Assistant Examiner*—Thuy Vinh Tran
*Attorney, Agent, or Firm*—Nathan O. Jensen; Kyle Eppele; J. P. O'Shaughnessy

[57] ABSTRACT

A fluorescent lamp controller for fluorescent lamps, the controller being responsive to the instantaneous power applied to the filaments and further generating a computed temperature signal to drive a filament as a function of the thermal characteristics of time versus temperature of the filament where the controller further controls application of arc power to the fluorescent lamp based upon the computed temperature signal.

20 Claims, 1 Drawing Sheet

METHOD AND APPARATUS FOR CONTROL OF FLUORESCENT LAMPS

FIELD OF THE INVENTION

The present invention generally relates to fluorescent lamps, and more particularly relates to avionics fluorescent lamps, and even more particularly relates to methods and apparatus of rapidly warming filaments in avionics fluorescent lamps and for otherwise controlling the lamp.

BACKGROUND OF THE INVENTION

In the past, avionics engineers have struggled with frequent interruptions and disturbances in the primary input power of avionics equipment. One particular problem resulting from such power disturbances has been the rapid cooling of filaments in a fluorescent lamp. One common way of dealing with this loss of power and concomitant reduction in filament temperature is to provide a standardized heating current to flow through the filaments while the arc power is disabled. In other situations, the arc power is immediately applied upon the end of the primary power interruption.

While these approaches to post primary power interruption lamp operation may have many advantages in particular uses, they also have significant drawbacks. One drawback of standardized heating current is that it often is set at a time of approximately six seconds and as such, is often far in excess of what is needed, especially if the primary power interruption lasted less than 50 ms. A drawback of the immediate provision of arc power is that it can cause damage to the lamp if done repeatedly.

Consequently, there exists a need for improved methods and apparatuses for driving fluorescent lamps after an interruption of primary power to the lamp.

SUMMARY OF THE INVENTION

It is an object of the present invention to provide increased lamp usage.

It is a feature of the present invention to include a filament heater controller which is responsive to the duration of a primary power interruption.

It is an advantage of the present invention to eliminate the need for standardized heater drive times.

It is another object of the present invention to enhance lamp life.

It is another feature to provide filament heating to all filaments requiring such heat.

It is another advantage of the present invention to provide only the sufficient filament drive heat to avoid unnecessary lamp damage.

The present invention is an apparatus and method for recovering from an interruption in primary power, which is designed to satisfy the aforementioned needs, provide the previously stated objects, include the above-listed features and achieve the already articulated advantages. The present invention is carried out in an "excessive heating time-less" and "excessive lamp damage-less" manner in a sense that excessive heating times and/or unnecessary lamp damage resulting from lack of proper filament heat have been greatly reduced.

Accordingly, the present invention is a fluorescent lamp drive apparatus and method which has a filament heater control which is responsive to the duration of an interruption in the primary power of the lamp.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
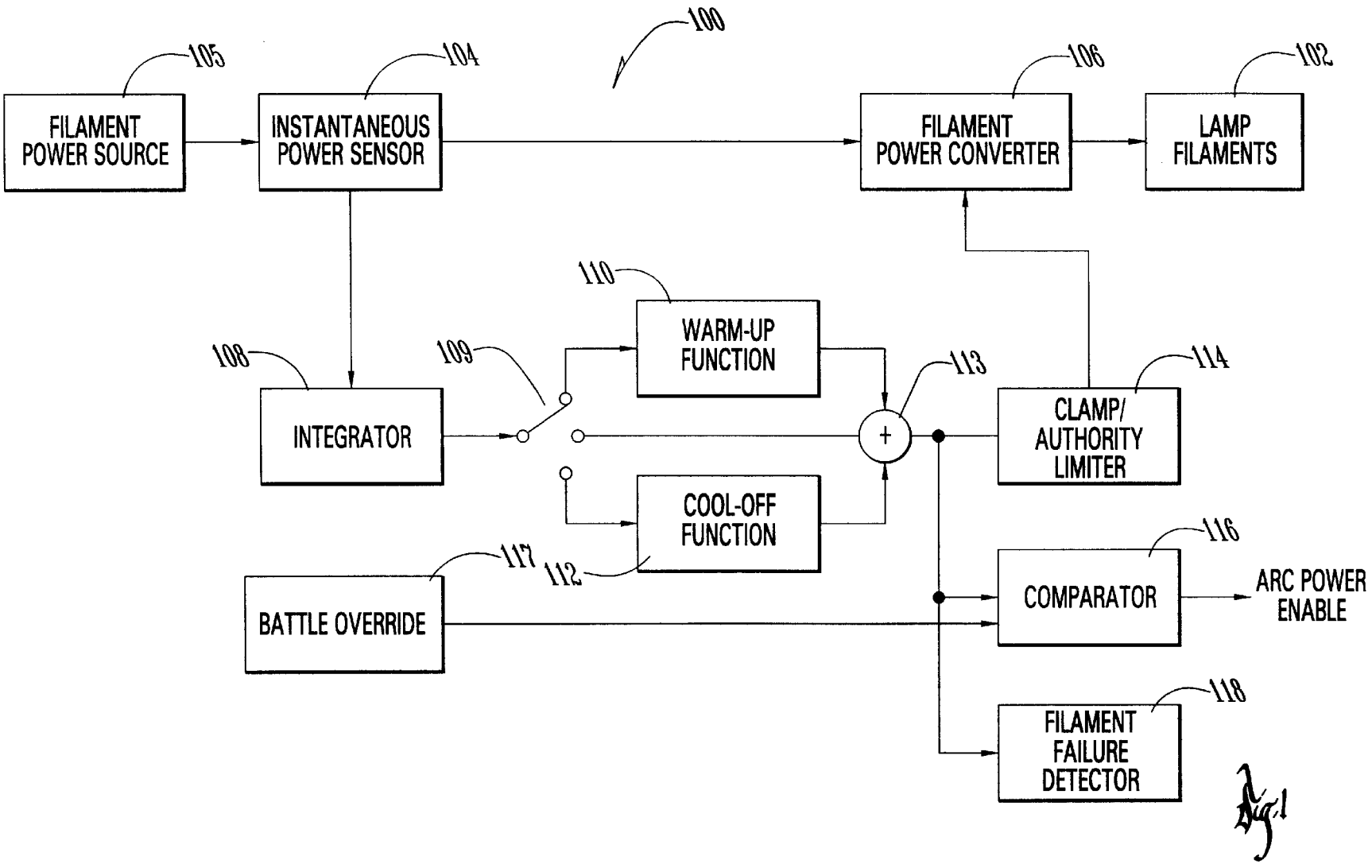
FIG. 1 is a simplified schematic block diagram of an apparatus of the present invention.

Now referring to the drawings, wherein like numerals refer to like matter throughout, there is shown in FIG. 1, a lamp filament system 100, of the present invention, which includes lamp filaments 102 and instantaneous power sensor 104, which is well known in the art for sensing power. A preferred instantaneous power sensor 104 could have a response time on the order of 100 microseconds. Instantaneous power sensor 104 is coupled to the filament power source 105, which is of the type which is subject to interrupts, for example, an avionics display power source. Instantaneous power sensor 104 provides a continuous signal representative of the instantaneous power level to integrator 108, which could be any type of integrator, including simple op-amps or a dedicated integrated circuit. The output of integrator 108 is a signal which is related to the filament temperature of lamp filaments 102. Integrator 108 may also perform a derivative function. If this output of integrator 108 is dropping, then switch 109 is caused to toggle to provide the signal to cool-off function 112. Conversely, if the output of integrator 108 is increasing, then switch 109 provides the output of integrator 108 to warm-up function 110. If the output of integrator 108 is not changing then no further conditioning of the signal is required and the signal is applied directly to summer 113. Warm-up function 110 is performed by circuitry which is well known in the art and may be a few simple op-amps or a dedicated integrated circuit, depending upon the particular needs of each individual application. Warm-up function 110 has predetermined characteristics which are a function of the particular physics of the lamp filaments in use. Warm-up function 110 provides a signal which is better representative of the filament temperature of lamp filaments 102 because it accounts for the temperature lag inherent when power is being applied to the filament. Similarly, cool-off function 112 provides an output signal which is better representative of a filament temperature of a cooling filament. The physics of the particular filament used will dictate the precise output of cool-off function 112, but in general, cool-off function 112 accounts for well-known, or earlier calibrated cooling off time versus temperature curves for the particular filaments used. Summer 113 collects the signals from warm-up function 110 and cool-off function 112 or the normal operation path and provides a computed temperature signal to clamp/authority limiter 114. Essentially clamp/authority limiter 114 is a filament power level drive controller which performs the function of limiting the drive power to lamp filaments 102 from excessive and damaging levels. Consequently, the output signal from clamp/authority limiter 114 to filament power converter 106 is a signal commanding the level of power to be driven by filament power converter 106. The signal coming out of summer 113 is provided to comparator 116, which compares this computed filament temperature signal with a predetermined reference level. If the computed temperature signal is greater than the reference level, then the arc power is provided to the lamp in a well-known manner. Also shown is a battle override signal 117, which is representative of a predetermined condition, such as a military aircraft in combat etc., which can override the functions of comparator 116 and thereby command arc power irrespective of an otherwise insufficient computed filament temperature. Another possible feature of the present invention is filament failure detector 118, which monitors the computed temperature from summer 113 and declares a filament failure if the temperature remains too low for an extended time period. This is done in a well-known manner.

All of the components of lamp filament system 100 are individually well known in the art and may be performed with discrete circuitry for each function, or in a preferred embodiment, they can be combined to share components as in an integrated circuit. For example, integrator 108, switch 109, warm-up function 110, cool-off function 112 and summer 113 could be readily combined and performed by a few op-amps. The precise configuration will be dependent upon the particular needs of each application.

The description herein focuses on hardware implementations such as op-amps and integrated circuits however, it should be understood that other implementations such as using a processor and computer software could be readily used as well. It is the intention of the present invention and the claims to include any software implementation as well.

It is thought that the method and apparatus of the present invention will be understood from the foregoing description, and that it will be apparent that various changes may be made in the form, construct steps and arrangement of the parts and steps thereof, without departing from the spirit and scope of the invention or sacrificing all of their material advantages. The form herein described is merely a preferred exemplary embodiment thereof.

I claim:

1. An apparatus comprising:

a fluorescent lamp filament;

an instantaneous power sensor, sensing power supplied to said fluorescent lamp filament and generating a power level signal;

an integrator for generating an integrated power level signal which is representative of a temperature characteristic of said fluorescent lamp filament;

generating means comprising a summer, which is responsive to said integrated power level signal and based upon predetermined time versus temperature characteristics of said fluorescent lamp filament for generating a filament specific computed temperature signal;

a limiter for limiting excess power applied to said fluorescent lamp filament.

2. An apparatus of claim 1 wherein said predetermined time versus temperature characteristics of said filament comprise cool-off state relating to time versus temperature characteristics of a predetermined filament with no power applied thereto and in a process of cooling.

3. An apparatus of claim 2 wherein said predetermined time versus temperature characteristics of said filament comprise warm-up state relating to time versus temperature characteristics of a predetermined filament with power applied thereto and in a process of heating.

4. An apparatus of claim 3 wherein said warm-up state further comprises characteristics of any initial lag time characteristic relating to a lag in temperature increases when power is initially applied to a filament.

5. An apparatus of claim 4 further comprising a comparator, which compares said computed temperature signal to a predetermined reference temperature level and issues an arc power enable signal in response thereto.

6. An apparatus of claim 5 further comprising a filament failure detector which determines if said computed temperature signal is below a predetermined filament failure reference level for a predetermined time interval and generates a filament failure alert signal in response thereto.

7. An apparatus of claim 6 further including an override input which permits issuance of arc power enable signals, irrespective of said computed temperature signal.

8. An apparatus of claim 7 wherein said instantaneous power sensor operates with a response time within one order of magnitude of 100 microseconds.

9. An apparatus of claim 8 wherein said integrator further performs a derivative function and switches an output of said integrator to two separate channels of said generating means where a first of said separate channels applies said cool-off state of said predetermined time versus temperature characteristics of said filament.

10. An apparatus of claim 9 wherein said integrator and said generating means comprise a plurality of op-amps.

11. An apparatus of claim 9 wherein said integrator, said generating means, said comparator, said limiter, and said filament failure detector are combined within a single application specific integrated circuit.

12. An apparatus of claim 1 wherein said instantaneous power sensor operates with a response time within one order of magnitude of 100 microseconds.

13. A fluorescent lamp system comprising:

means for sensing power applied to a fluorescent lamp filament, and generating an instantaneous power signal;

means for generating a computed filament temperature signal based upon said instantaneous power signal; and, means for controlling power applied to said fluorescent lamp filament in response to said computed filament temperature signal.

14. An apparatus of claim 13 further comprising means for comparing said computed filament temperature signal with a predetermined reference temperature signal and generating an arc power enable signal in response thereto.

15. An apparatus of claim 14 wherein said means for generating is based upon a predetermined time versus temperature characteristic of a predetermined lamp filament.

16. An apparatus of claim 15 wherein said predetermined time versus temperature characteristic is representative of lag time between when power is applied to a filament and when said filament experiences an increase in temperature in response thereto.

17. An apparatus of claim 15 further comprising means for detecting a filament failure which is responsive to said computed filament temperature signal.

18. A method of controlling a fluorescent lamp comprising the steps of:

sensing power applied to a lamp filament, and generating a power level signal in response thereto;

estimating a temperature of said lamp filament in response to said power level signal and based upon predetermined thermal characteristics of said lamp filament, and generating an estimated temperature signal; and, providing power to said lamp filament in response to said estimated temperature signal.

19. A method of claim 18 further comprising the step of generating an arc power enable signal in response to said estimated temperature signal.

20. A method of claim 19 further comprising the step of declaring a filament failure in response to said estimated temperature signal.

* * * * *